United States Patent [19]

DeSantis

[11] Patent Number: 4,936,322

[45] Date of Patent: Jun. 26, 1990

[54] INGROWN TOENAIL PART REMOVER

[76] Inventor: Damian G. DeSantis, 1911 Greenfield Dr., El Cajon, Calif. 92019

[21] Appl. No.: 292,454

[22] Filed: Dec. 30, 1988

[51] Int. Cl.[5] ..... A45D 29/04

[52] U.S. Cl. ..... 132/75.6; 30/27; 132/73; 132/75.4

[58] Field of Search ..... 132/73, 75.6, 75.4; 30/26, 27, 29.5

[56] References Cited

U.S. PATENT DOCUMENTS

| | | | |
|---|---|---|---|
| Re. 15,663 | 6/1923 | Landis . | |
| 31,349 | 8/1899 | Lewald . | |
| 205,088 | 6/1878 | Hollman | 132/75.6 |
| 370,706 | 9/1887 | Kozmann . | |
| 490,377 | 1/1893 | Trebbin | 30/27 |
| 838,440 | 12/1906 | Neff | 132/75.4 |
| 843,602 | 2/1907 | Heimerdinger . | |
| 954,325 | 4/1910 | Moore | 30/26 |
| 1,002,377 | 9/1911 | Ekenborg . | |
| 1,015,472 | 1/1912 | Bredin . | |
| 1,219,626 | 3/1917 | Clark . | |
| 1,489,603 | 4/1924 | Kracht . | |
| 1,763,939 | 6/1930 | Ireharne . | |
| 2,479,514 | 8/1949 | Rucker | 132/75.6 |
| 2,801,640 | 8/1957 | Steele | 30/26 |
| 3,013,553 | 12/1956 | Averbach | 128/2 |
| 3,495,593 | 2/1970 | Snyder . | |

*Primary Examiner*—Kenneth J. Dorner
*Assistant Examiner*—J. Hakomaki
*Attorney, Agent, or Firm*—Henri J. A. Charmasson

[57] ABSTRACT

A hollow cylindrical rod having a tapered end is shaped to include a soft tissue depressor and separator surface and a safety knife surface. The safety knife surface is composed of a cutting edge placed within the port so that it only cuts portions of the ingrown nail within the port as the device is pulled away. The separator surface depresses and separates the soft tissue to expose the ingrown nail portion and maintains separation from the blade during cutting and space for cut nail fragments without contacting the soft tissue. The device may include a serrated surface to smooth any burrs from the cut nail surface. The tapered end can be angled or rotated around the cylindrical axis to increase separation or expose the knife blade to new nail portions while maintaining the separation between nail and soft tissue.

2 Claims, 1 Drawing Sheet

INGROWN TOENAIL PART REMOVER

FIELD OF THE INVENTION

This invention relates to pedicure instruments, more specifically to pedicure instruments to remove portions of ingrown toenails.

BACKGROUND OF THE INVENTION

The primary objectives of an instrument to remove portions of an ingrown toenail from a patient are to (1) depress soft tissue around the nail to expose the ingrown portion of the toenail, (2) remove the ingrown portion of the nail, and (3) remove the instrument without damage to the soft tissue. Instrument should be small so that it will not adversely impact the surrounding tissue or interfere with other portions of the body. It should also be light weight, rugged in construction, pleasing in appearance, easy to handle and manipulate during the precise nail removal process and low in cost.

Most of the current instruments may do one of these objectives well, but other objectives poorly or not at all. Common or specially adapted scissors and/or pliers type of instruments tend to pull the nail away from the soft tissue prior to cutting. Unless great care is exercised, this operation may cause injury to nail and soft tissue of the patient. This risk of injury is compounded since the soft tissue around the ingrown toenail may already be infected, injured and/or exceedingly sensitive. In addition, the small size of a scissors or pliers type of instrument adapted to ingrown toenail part removal requires a very skilled operator with steady hands in the best of circumstances.

Other prior approaches have been attempted to overcome the problems using tiny scissors and/or pliers in this application. One approach is an instrument to gently depress on the soft tissue to expose and file the ingrown toenail. This approach is illustrated in U.S. Pat. No. 2,479,514. Although this approach eliminates nail pulling and reduces the level of skill required, it requires extensive rubbing/filing action which may also injure the patient. Filing debris may also contaminate the injured or infected soft tissue areas.

Prior art safety knives (a protective surface proximate the cutting edge) have been used in pedicure and manicure applications, such as removal of exposed nails and corns on the hands or toes. These prior art safety knives could also be used for removal of ingrown toenails, once the ingrown nail portion is exposed from the soft tissue. These safety knives typically have a blade protective surface, spaced apart but opposite from the cutting blade. Related devices combine other pedicure devices (e.g., files and scissors) with a safety knife to trim, smooth or remove exposed items. These exposed nail and corn removal devices are illustrated in U.S. Pat. Nos.: Re 15,663; 1,219,626; 1,489,603; 1.002,377; 370,706; 843,602; 31,349. Other safety knife applications include surgical instruments, such as illustrated in U.S. Pat. Nos.: 1,763,939; 3,495,593; 1,015,472; and 3,013,553.

These prior art pedicure or manicure safety knife approaches have many limitations. These are primarily related to the need to gently depress and separate soft tissue away from the ingrown toenail prior to toenail part removal. The blade protective surface is not designed for this gentle depressing purpose, but to protect the blade and/or prevent the cutting blade from contacting other portions of the patient during cutting. These blade protective surfaces may break when exposed to the side loads caused by the unintended depressing the soft tissue or injure sensitive skin or other soft tissue. Proper separation of soft tissue from the ingrown toenail prior to cutting with prior art safety knives has required a separate depression/separation means to be used in conjunction with the safety blade to remove the ingrown nail portion.

Prior art safety blades and/or separate soft tissue depressors can also impair vision during the delicate nail portion removal operation. Good visibility is needed not only to perform the operation but to avoid further injury to infected or sensitive areas.

None of the prior art cited separates soft tissues from the ingrown nail portion to be removed and removes the nail portion without repeated movements. Visibility of the removal operation is also impaired in some of the prior art devices.

What is needed is a single device to separate and remove ingrown nail portions without repeated motions. This device should also provide good visibility and easy handling for the required precise depression, separation cutting and removal operations.

SUMMARY OF THE INVENTION

The principal and secondary objects of the invention are:

To provide a means to gently separate soft tissue from the ingrown toenail portion;

To provide a means to remove the ingrown toenail portion in the same device; and To provide easy handling and unimpaired visibility during the separation and removal functions.

These and other objects are achieved by a hollow cylindrical rod having a tapered end shaped to include a soft tissue depressor and separator surface and a safety knife surface. The safety knife surface is composed of a cutting edge placed within the port so that it only cuts portions of the ingrown nail within the port as the device is pulled away. The separator surface depresses and separates the soft tissue, exposing the ingrown nail portion and maintaining separation from the blade. The device may include a serrated surface to smooth any burrs from the cut nail surface. The tapered end can be angled or rotated to increase separation or expose the knife blade to new nail portions while maintaining the separation between nail and soft tissue.

DESCRIPTION OF THE PREFERRED EMBODIMENT

Figure 1:
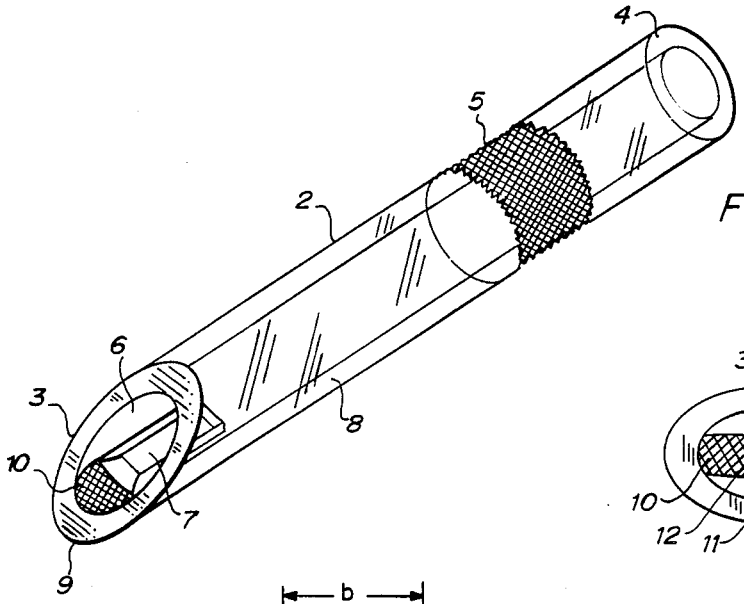
FIG. 1 shows a perspective view of an ingrown toenail part remover.

FIG. 1 shows a top perspective view of the preferred embodiment of the ingrown toenail part remover device. A hollow transparent plastic rod 2 has a tapered end 3 distal from a handle end 4 which is proximate a knurled surface 5. The knurled surface 5 allows the device to be easily rotated about the cylindrical axis between the fingers of an operator's hand, while the transparent material allows operator visibility. The inner surface 6 of the rod 2 has a dimension or diameter "a" of 0.15 cm (0.06 inch) and the outer diameter "b" is equal to 0.30 cm (0.12 inch) in the preferred embodiment (see FIG. 3). These dimensions are selected to allow one dimension of the port 7 to be slightly larger, but comparable to the thickness of a human nail, but the outer diameter may be significantly larger than the thickness of a human nail. The tapered end 3 includes a port 7 extending from the inner surface 6 to the outer surface 8. The port 7 is located proximate the rounded and smooth tip 9 on the tapered end 3. The exposed surfaces at the tapered end serve as a depressor and separator of soft tissue (see FIG. 5). Because of the tapered shape of the end 3 of rod 2, the separation distance "c" (see FIG. 5) is adjustable by varying the insertion angle "d" and rotation around the cylindrical axis "e". A serrated surface 10 is provided between the tip 9 of the tapered end 3 and the port 7. The serrated surface acts as a file and/or burr removal surface for newly exposed (cut) portions of the nail (see FIG. 5).

Figure 2:
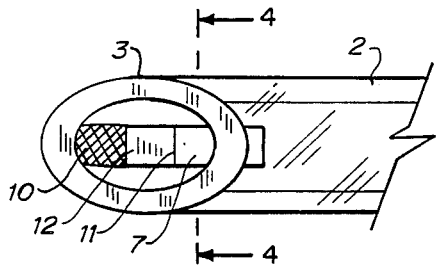
FIG. 2 shows a partial top view of the ingrown toenail part remover.

FIG. 2 is a top view of the tapered end 3 of the rod 2. The serrated or filing surface 10 provides a means to remove sharp edges from the cut nail surface. Serrated surface 10 in other configurations may be placed on other surfaces of the end 3 of the cylindrical rod 2 as shown. The port 7 and cutting edge 11 together act as a safety knife. The cutting edge 11 may be a separate component, such as steel blade attached to the plastic tapered rod end 3, or made in one piece from the plastic. The ramped surface 12 interconnects the cutting edge with the inner surface 6. The cutting edge is shaped to cut items placed within the port 7 as the tapered rod end 3 is translated towards the knurled end (see FIG. 1).

Figure 3:
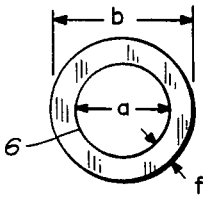
FIG. 3 shows an end view the ingrown toenail part remover.

FIG. 3 is a side view of the rod 2, looking at the handle end proximate the knurled portion (see FIG. 1). The inner cylindrical surface 6 of the rod 2 has a diameter "a". The thickness of the rod "f" is determined by the need for separating the nail and soft tissue (see FIGS. 5 and 6) as well as structural strength of the plastic to withstand side loads when depressing the soft tissue.

Figure 4:
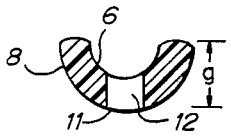
FIG. 4 shows a cross sectional view of the ingrown toenail part remover taken along line 4—4 of FIG. 3.

FIG. 4 is a side cross sectional view 4—4 of the tapered end 3 as shown in FIG. 3. Minimum separation distance "g" separates soft tissue from cutting edge 11 when insertion angle "d" is zero (see FIG. 5). All of the exposed surfaces 6 and 8 of the tapered end 3 are smooth, shaped and dimensioned (except the cutting edge) to depress, separated and minimize injury to the soft tissue during use. The cutting edge is proximate the outer surface 8, having a ramped surface 12 to the inner surface 6 (see FIG. 2). The ramp deflects removed nail portions away from the remaining nail portion. The minimum separation distance "g" also provides space within diameter "a" (see FIG. 3) for nail portions removed by cutting edge 11 without contacting the soft tissue (see FIG. 5).

Figure 5:
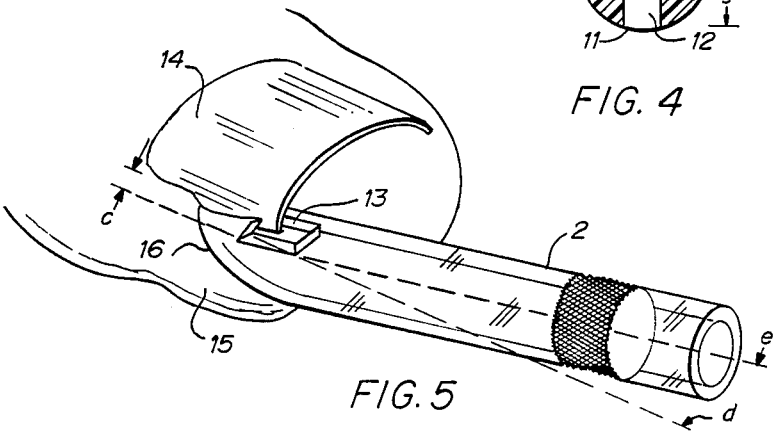
FIG. 5 shows a side view of the ingrown toenail part remover beginning to remove the ingrown portion of a toenail.

FIG. 5 shows an alternate device (without filing surface) beginning to remove a portion 13 of a human toenail 14 which had been growing into the skin or soft tissue 15. The separation distance "c" is provided by portions of the inner and outer surfaces 6 and 8 (see FIGS. 1 and 4) and the angle of insertion "d" measured from the axis "e" of the cylindrical rod 2 and approximate plane of the depressed soft tissue 15 at the point 16 where the nail portion 13 has ingrown. The tapered end of rod 2 can be used to depress the soft tissue 15 and the point 16 in the position shown, or it may be rotated 180 degrees around axis "e" to use the outer surface 8 to depress the soft tissue.

Figure 6:
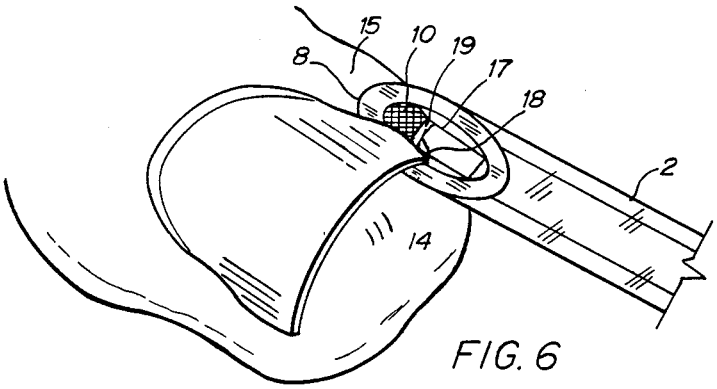
FIG. 6 shows a side view of a portion of an alternate embodiment after removal of the ingrown portion of a toenail.

FIG. 6 is a side view of a portion of another alternate embodiment of the device. Alternate cutting edge 17 is attached proximate to the inner surface 6 at the end of a ramp 19 slanted in opposite direction to the ramped surface 12 of the first embodiment. Separation between the skin or soft tissue 15 is maintained by the outer surface 8. The cut edge of the nail 14 is in contact with the serrated surface 10 to remove burrs and sharp edges prior to removal of the device. Removed portions 18 of the ingrown toenail are deflected away from the soft tissue by ramped surface 19.

While the preferred embodiment of the invention has been shown and described, and some alternate embodiments also shown and described, changes and modifications may be made therein within the scope of the appended claims without departing from the spirit and scope of this invention.

What is claimed is:

1. A device for trimming a nail ingrown into a skin portion comprising:

a generally cylindrical tubular rod made of transparent plastic material and having a proximal end, a distal end, an outer surface and an inner surface generally coaxial with said inner surface; said rod being diagonally sectioned at said distal end to form a tapered, rounded tip contiguous with an elliptical base ring defined between said outer and inner surfaces, and having a serrated surface portion shaped and dimensioned to remove burrs from a cut portion of the nail;

said tip having a lateral aperture lying within an elliptical cylinder normal to the axis of the rod and tangential to the inner periphery of said ring; and a wall portion of said aperture closest to said distal end being slanted inwardly and distally forming a cutting edge at the intersection of said wall portion and said outer surface.

2. The device claimed in claim 1 which also comprises a knurled portion of said outer surface near said proximate end.

* * * * *